US008801420B2

(12) United States Patent
Meissner et al.

(10) Patent No.: US 8,801,420 B2
(45) Date of Patent: Aug. 12, 2014

(54) DIE PLATE

(75) Inventors: Friedrich Meissner, Hamburg (DE); Stefan Luedemann, Hamburg (DE)

(73) Assignee: Fette Compacting GmbH, Schwarzenbek (DE)

( * ) Notice: Subject to any disclaimer, the term of this patent is extended or adjusted under 35 U.S.C. 154(b) by 600 days.

(21) Appl. No.: 13/038,033

(22) Filed: Mar. 1, 2011

(65) Prior Publication Data

US 2011/0223277 A1 Sep. 15, 2011

(30) Foreign Application Priority Data

Mar. 4, 2010 (DE) ..... 10 2010 010 209

(51) Int. Cl.
*B30B 11/08* (2006.01)

(52) U.S. Cl.
USPC ..... 425/193; 425/345

(58) Field of Classification Search
USPC ..... 425/193, 195, 345, 353, 348 R
See application file for complete search history.

(56) References Cited

U.S. PATENT DOCUMENTS 3,565,016 A * 2/1971 Christie ..... 425/195
5,843,488 A * 12/1998 Korsch et al. ..... 425/193

FOREIGN PATENT DOCUMENTS

| | | |
|---|---|---|
| DE | 3003238 | 8/1981 |
| DE | 4401358 | 7/1995 |
| DE | 29720204 | 3/1998 |
| JP | 2001353597 | 12/2001 |
| JP | 200528439 | 2/2005 |

* cited by examiner

*Primary Examiner* — Amjad Abraham
*Assistant Examiner* — Ninh Le
(74) *Attorney, Agent, or Firm* — Vidas, Arrett & Steinkraus

(57) ABSTRACT

A die plate for the rotor of a rotary tablet press comprising a plurality of die holes, with dies provided therein, arranged distributed in the circumferential direction of the die plate, and between every two adjacent die holes radially running bores, in each of which a fastening device is disposed for fastening the dies, characterized in that at least one fastening device comprises two clamping elements disposed opposite each other in a radial bore, and a tensioning device, wherein the clamping elements can be tensioned against each other in the radial direction using the tensioning device, wherein the clamping elements are pressed against the dies adjacent to the radial bore.

15 Claims, 2 Drawing Sheets

DIE PLATE

CROSS-REFERENCE TO RELATED APPLICATIONS

Figure 1:
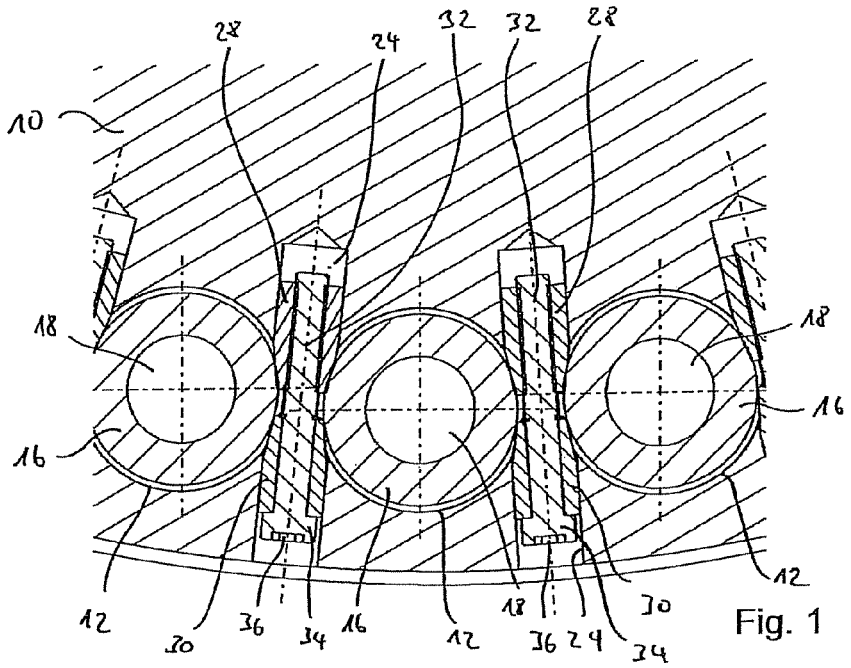

Not applicable.

STATEMENT REGARDING FEDERALLY SPONSORED RESEARCH

Not applicable.

BACKGROUND OF THE INVENTION

The invention relates to a die plate for the rotor of a rotary tablet press comprising a plurality of die holes, with dies provided therein, arranged distributed in the circumferential direction of the die plate, and radial bores, running between every two adjacent die holes, in each of which a fastening device is disposed for fastening the dies. Known fastening devices for fastening dies have a conical bolt and a set screw assigned to this. The conical bolts of the fastening devices are each inserted into a radial bore of the die plate. Following that, the set screws are screwed into the radial bores, wherein the conical bolts are in each case pressed against dies disposed adjacent to the radial bores.

These known fastening devices have a few disadvantages. For example, the set screws are screwed from the circumferential outside of the die plate into the internal thread formed in the radial bores, where they press the conical bolts located further inward in the radial direction against the dies. This design requires significant construction space in the radial direction, whereby the necessary outer diameter of the die plate and thus the dimensions of the rotary tablet press increase undesirably. Furthermore, threaded bores must be provided in the die plate for the set screws, which is costly. In the case of damage to the thread, they cannot be exchanged. Specifically with the high chrome tools frequently used here, the threads are prone to increased wear, particularly to seizing. Defective threads, in turn, increase the risk that dies can loosen from the plate which can lead to damaging the machine. Furthermore, the radial threaded bores, into which the set screws are screwed, cannot be cleaned in a satisfactory manner. In addition to this, there is the fact that the dies are held by the conical bolts in each case only at two sections of their outer surface at the dies. In adverse cases, this can lead to a tilting or tipping of the dies. This in turn, leads to inaccuracies of the fit, and thus to an increased wear of the dies, and to the press punches interacting with them. Beyond that, the known fastening devices exert strong forces on the dies in the radial direction. This is disadvantageous for maintaining the positioning of the dies, and can lead to a deformation of the dies. As a result, the press punches of the rotary press can, in turn, rub against the inner wall of the dies, leading to increased wear.

Starting from the described prior art as a background, the object of the invention is to provide a die plate of the initially named type which is structurally more compact, more robust and which makes possible a uniform and precise fastening of the dies in a wear resistant manner.

The invention solves this objective by the subject matter of claim 1. Advantageous embodiments are found in the dependent claims, the description and the drawings.

The object of the invention is solved for a die plate of the initially named type in that at least one fastening device comprises two clamping elements disposed opposite each other in a radial bore, and one tensioning device, wherein the clamping elements can be tensioned against each other in the radial direction using the tensioning device, wherein the clamping elements are pressed against the dies adjacent to the radial bore.

Naturally, all of the fastening devices of the die plate are designed in the inventive manner. The die plate can be designed to be integrally formed or consist of die segments. The die plate is designed to have a circular ring shape, for example. It is part of a rotor of a rotary table press and can be driven rotatingly together with the rotor about a typically vertical axis of rotation. A plurality of holes for receiving dies, with dies disposed therein, are located in the die plate axis parallel to the axis of rotation of the die plate and of the rotor. A cylindrical bore, for example, running in each case between two adjacent die holes, runs radially to the axis of rotation of the die plate and the rotor of the press. An inventive fastening device having clamping elements is disposed in at least one, for example, in all of these radial bores. The clamping elements located respectively across from each other in a radial bore form a clamping element pair. At least one, preferably both clamping elements of a clamping element pair are already inserted into the respective radial bores before the insertion of the dies into the die holes.

The radial bores each create a connection between each of two adjacent die holes so that the clamping elements of a clamping element pair, with dies inserted into the die holes, can come into contact with both dies adjacent to the radial bore or adjoining the radial bore. Clamping elements opposite each other in a radial bore are pressed according to the invention during tensioning by means of the tensioning device assigned to them, respectively, from opposite sides against the dies adjoining to the radial bores. A radially inner clamping element of a clamping pair is located before and also possibly after tensioning at least in sections within the die hole or a center vertical axis of the die hole, as viewed in a radial direction. The other, radially outer clamping element of the clamping element pair is located correspondingly before and also possibly after tensioning at least in sections outside of the die hole or a center vertical axis of die hole, as viewed in a radial direction. Naturally, the clamping elements must not come directly into contact with the dies during tensioning. It is also conceivable that a force transfer means, for example an elastic intermediate layer, is disposed between the clamping elements and the dies, which transfers the compressive force generated during tensioning the clamping elements onto the dies.

According to the invention, the dies are each held at four sections by the clamping elements disposed particularly on both sides of the dies. Thereby, tipping or other misalignment of the dies is reliably avoided, and retaining forces are more uniformly introduced. Furthermore, by pressing the clamping elements, disposed in a radial bore, from opposite sides against the dies, the dies are fastened without radial forces acting on the dies. Thereby, twisting or misalignment of the dies is reliably excluded. Furthermore, in particular, the inventive radial bores in the die plate do not themselves have a thread. In this way, the clamping elements are freely movable in the radial bore and can be placed against the respective die without twisting. Furthermore, the formation of the radial bore without threads simplifies the production. Also, steps within the bores, which are required in the prior art for diameter expansions of the radial bores, are not necessary according to the invention. Rather, the radial bores can, in a simple manner, be cylindrical bores. Because the radial bores do not require a thread, cleaning is also simplified. Furthermore, in operation the radial bores are subjected to practically no wear, so that damage, and with it also a possibly required exchange, can be avoided. Finally, according to the invention, a reduction of the required construction space is achieved particularly in the radial direction, in particular a reduction of the length of the radial bores. Therefore, the die plate in turn can also be constructed more compactly.

For a further improved fastening of the dies, the clamping elements can each have two clamping surfaces, with which they are pressed against the dies adjacent to the radial bore. Thereby, force is introduced more uniformly. A further more uniform introduction of force, and with it an optimized die fastening is attained if according to a further design the clamping surfaces of the opposite clamping elements taper at least in sections in the direction of the respective other clamping element. The clamping surfaces can taper, in particular, conically. With this design, in the course of tensioning, an automatic self centering of the clamping cone occurs in the radial bores, so that twisting and with it misalignment of the dies is reliably avoided.

According to a further design, a first of the two clamping elements can be designed sleeve-shaped having an internal thread, and the tensioning device has a dowel pin having an external thread, wherein the clamping elements can be tensioned against each other in the radial direction by screwing the dowel pin into the internal thread of the first clamping element. A particularly simple tensioning of the clamping elements and with this, fastening of the dies, is attained in this manner. The radial bore can be accessible particularly from the circumferential side of the die plate. A screwing of the clamping elements by the set screw from the outside is then possible in a particularly simple manner. The sleeve-shaped first clamping element having an internal thread can in particular be the radially inward located clamping element of the two clamping elements. It can then be further provided that the second clamping element is also designed sleeve-shaped, wherein the dowel pin is guided through the second clamping element and can be screwed with its end protruding out of the second clamping element into the first clamping element, and the dowel pin has a stop on which the second clamping element is supported during tensioning of the clamping elements. Here, the second clamping element has, in particular, no internal thread. Rather, the set screw can simply be inserted through this clamping element. The second clamping element is supported against the stop surface which is formed as a flange-like expansion at the screw head, for example.

According to a further design, a transfer device can be provided that takes the second clamping element along with it during removal of the dowel pin from the radial bore. The transfer device can comprise a locking ring disposed at the dowel pin, wherein the second clamping element is held between the stop and the locking ring. The locking ring can be integrally connected to the dowel pin, for example. It ensures that the second clamping element, held between the stop and the locking ring, during withdrawal from the radial bore, particularly unscrewing out of the first clamping element, is also taken along and likewise removed. This simplifies maintenance of the fastening device. Alternatively, it is also possible that the second clamping element and the dowel pin are formed integrally.

According to a further design it can be provided that the first clamping element and the dowel pin are formed integrally, and the second clamping element is formed sleeve-like, wherein the dowel pin is guided through the second clamping element so that the dowel pin extends with one end out of the second clamping element and that the dowel pin has an external thread at least in one area of its end extending out of the second clamping element, upon which a screw nut can be screwed for tensioning the clamping elements against each other.

For a particular uniform and defined the fastening of the dies, the clamping elements during tensioning can engage in annular grooves, which are formed on the outer surfaces of the dies adjacent to the radial bore. The dies can, in a known manner, comprise a cylindrical shape, for example. The annular grooves can, also in a known manner, be designed as (partially) circular in cross-section, for example. Naturally, all dies can have such an annular groove. It can be further provided that at least the die holes for dies that are adjacent to the radial bores receiving the clamping elements, have a collar as an abutment surface for the dies. Using such a collar guarantees a secure hold of the dies and a defined position in the holes before tightening the clamping elements. Naturally, all die holes can in turn have such a collar.

It can be further provided that the center axis of the radial bore receiving the clamping elements is disposed offset with respect to the annular grooves of the dies adjacent to the radial bore, such that the dies during tensioning of the clamping elements against each other are pressed against the respective collar of their die hole. The center axes of the radial bores can be disposed offset with respect to the annular grooves particularly in the axial direction of the die plate, for example to the center axes of the annular grooves that are partially circular in cross section. In this manner, during tensioning of the clamping elements, the dies are pressed against the collar. As a result, a precise and defined fastening of all dies in the receiving hole assigned to each is achieved.

According to a further design, means for the lock against rotation can be provided which prevent a rotation at least of one clamping element in the radial bore. The means for the lock against rotation comprise a projection formed on the clamping element or the radial bore, and a groove, running in the insertion direction of the clamping element in the radial bore, formed on the respectively other clamping element or radial bore, wherein the projection engages in the groove so that a rotation of the clamping element in the radial bore is prevented. In particular, due to the lock against rotation, only the rotation of a first clamping element, namely, for example, the clamping element formed sleeve-shaped and provided with an internal thread, is prevented, so that the dowel pin can be screwed into the first clamping element. The projection can be formed pin-shaped, for example.

Furthermore, the invention relates to a rotary tablet press comprising a rotor that can be driven rotatingly about an axis of rotation, particularly a vertical axis of rotation, that has an inventive die plate and comprises upper and lower punches assigned to the die holes of the die plate, running synchronously with the die plate.

Figure 2:
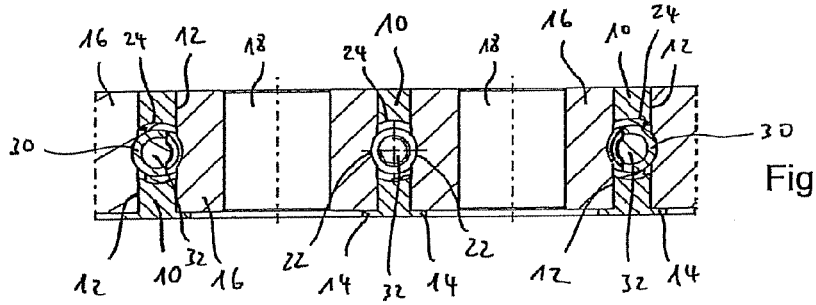
Figure 3:
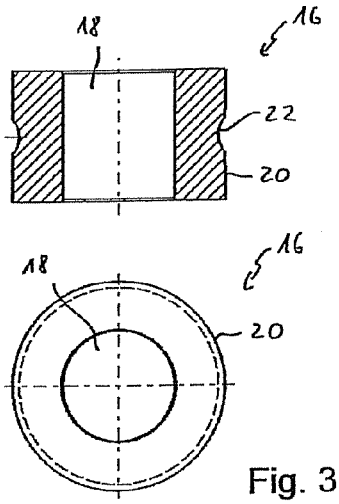
Figure 4:
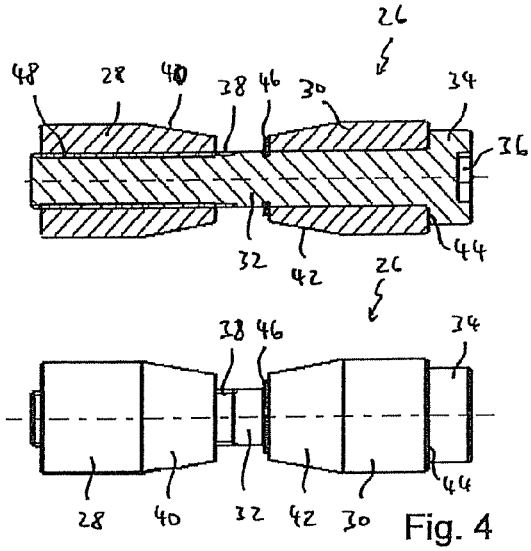
Figure 5:
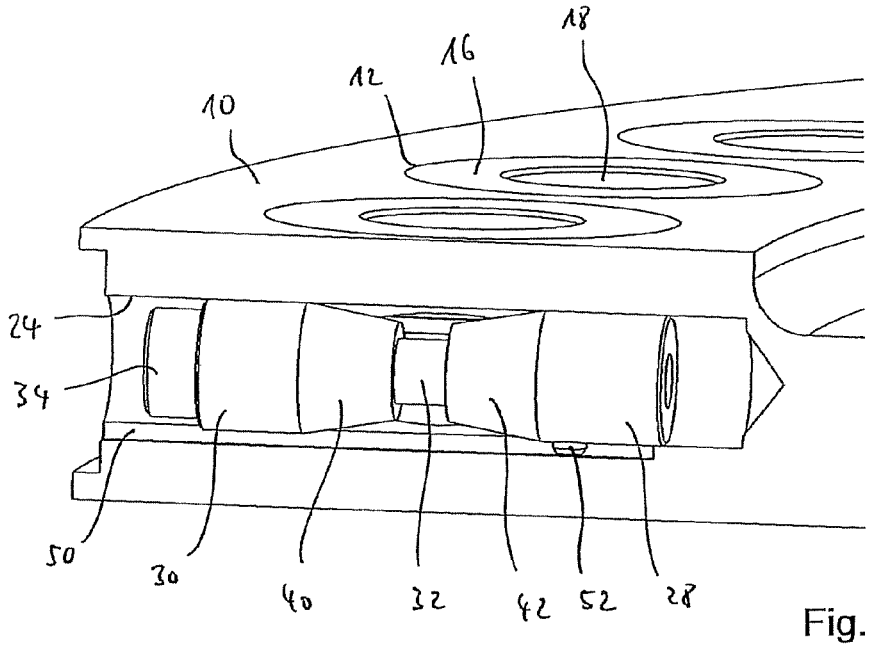
Figure 6:
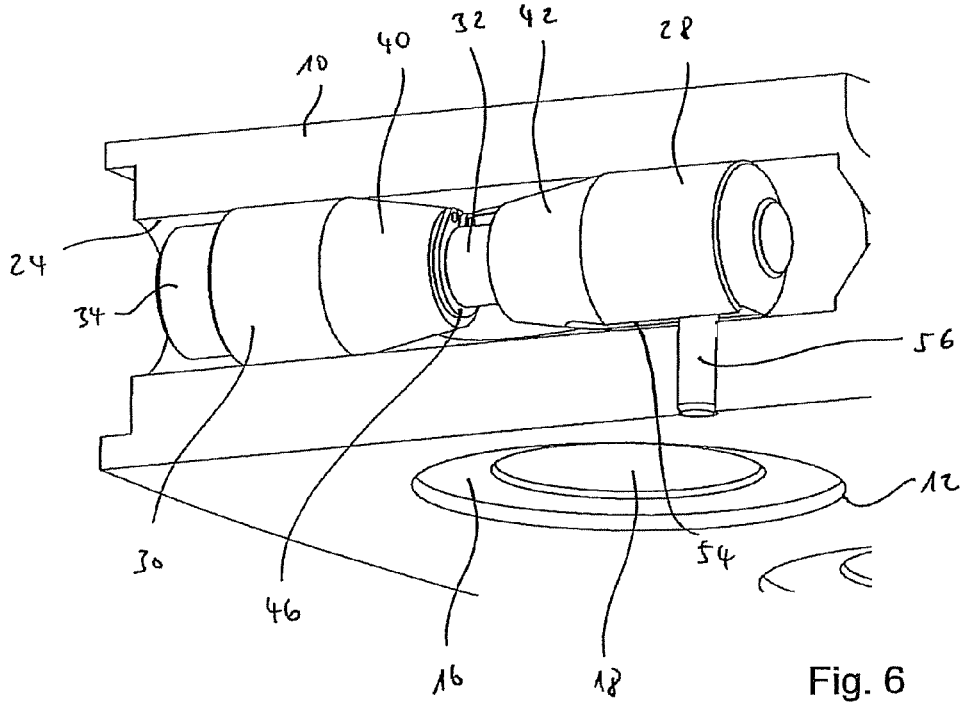

An example embodiment of the invention is explained in more detail in the following using the drawings. They show schematically:

FIG. 1 a section of an inventive die plate in a first sectional view,

FIG. 2 a section of the die plate shown in FIG. 1, in a second sectional view, FIG. 3 a die of the inventive die plate in two views, FIG. 4 a fastening device of the inventive die plate in two views, FIG. 5 a perspective sectional view of a part of the inventive die plate according to a further exemplary embodiment, and FIG. 6 a further perspective sectional view of a part of the inventive die plate according to a further exemplary embodiment.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In the figures, the same reference numbers refer to the same objects unless indicated otherwise. FIG. 1 shows a section of an inventive die plate 10 in a horizontal sectional view. FIG. 2 also shows a section of the inventive die plate 10 in a vertical sectional view. The die plate 10 is part of a rotor of a rotary tablet press (not shown). The die plate 10 in the example shown is designed having a circular shape, and can be rotated together with a rotor about a vertical axis of rotation. The die plate 10 has a plurality of die holes 12 arranged distributed in the circumferential direction of the die plate 10 at regular intervals. In the FIGS. 1 and 2, it can be seen that the die holes 12 are cylindrical holes which each have a circumferential collar 14 at their lower end in FIG. 2. Cylindrical dies 16 that are received in each of the holes 12, rest in each case with their lower side on the collar 14 of the hole 12 assigned to them. The dies 16 each have a central opening 18 in which material to be pressed in a known manner in the rotary tablet press, is pressed by means of upper and lower punches (not shown) assigned to the die plate 10.

FIG. 3 shows in the upper image, a die 16 in a vertical section. The lower image shows the die 16 in a top view. It can be seen in the upper image of FIG. 3 that the die bushing 16 has a central circumferential annular groove 22 in the area of its outer surface 20. The annular groove 22 has a semi-circular cross section in the example shown. All of the dies 16 in the represented example have such an annular groove 22.

It can also be seen in FIGS. 1 and 2 that radial bores 24 are formed in the die plate 10 in each case between two adjacent die holes 12, and thus also between the dies 16 held in them. In the example shown, the radial bores 24 are cylindrical bores without inner threads, introduced into the die plate 10 from its circumferential side. A fastening device 26, shown enlarged in FIG. 4, is disposed in each of the radial bores 24. In the lower partial image in FIG. 4, the fastening device 26 is shown in a lateral view. In the upper partial image in FIG. 4, the fastening device 26 is shown in a sectional view. Each of the fastening devices has a first clamping element 28 and a second clamping element 30. In addition, the fastening devices 26 have a set screw 32. The set screw 32 comprises a head 34 having an engagement 36 for a tool, for example an Allen wrench, or similar. The set screw 32 has an external thread 38 at its end facing away from the head 34. The first and second clamping element 28, 30 are formed sleeve-shaped in the example shown, and at their ends opposing each other each comprise a cone shaped taper 40, 42. The clamping elements 28, 30 taper in the direction toward the respective other clamping element 28, 30. It can be seen in FIG. 4 in particular that the set screw 32 in its section having no external thread and near the head 34, is passing through the second clamping element 30, which has no internal thread. The second clamping element 30 is held between a stop surface 44 formed by the lower side of the head 34 on one side, and on the other side by a flange-like ring 46 projecting from the set screw 32. The first clamping element 28, in contrast, comprises an internal thread 48 into which the set screw 32 with its thread 38 is screwed. As can be seen in FIG. 4 for example, both clamping elements 28, 30 can be tensioned against each other by screwing the set screw 32 into the first clamping element 28.

FIGS. 1 and 2 show the installed state of the fastening devices 26 in the die plate 10. For assembly, the fastening devices 26 are slid into the radial bores 24 already before the insertion of the dies 16. In this state, the radially inward located first clamping element 28 is located at least in sections radially within the center vertical axis of adjacent die holes 12 or dies 16. In this state, the radially outward located second clamping element 30 is located correspondingly radially outside of the center vertical axis of the die holes 12 or dies 16. The set screw 32 is unscrewed out of the first clamping element 28 sufficiently far enough so that the cone-shaped tapered clamping surfaces 40, 42 permit the insertion of the dies 16 into the die holes 12. It should be pointed out that the radial bores 24 in each case connect adjacent die holes 12 to each other.

As soon as the dies 16 are inserted into the die holes 12, the set screws 32 of the fastening devices 26 are screwed into the first clamping elements 28. The clamping elements 28, 30 are respectively tensioned against each other, and with their cone-shaped clamping surfaces 40, 42 come into abutment with the dies 16, and fix the dies in the holes 12 in this manner. In particular, the cone-shaped clamping surfaces 40, 42 come into engagement with the annular grooves 22 of the dies 16. In this manner, the dies 16 are reliably and precisely fixed in the holes 12 receiving the dies. If individual dies 16 are to be removed from the holes 12 for maintenance, for example, the set screws 32 of the fastening devices 26 adjacent to these dies 16 are unscrewed again out of the respectively first clamping elements 28, so that the dies 16 can be removed from the receiving hole 12.

In the example shown, the center axis of the radial bores 24 receiving the fastening devices 24 are each offset with respect to the center and base of the annular grooves 22 so that each of the dies 16 during tensioning of the clamping elements 28, 30 are pressed against the collars 14 of the holes 12 receiving the dies. Thereby, a particularly defined and precise positioning of the dies is achieved. In particular, in the example shown, the center axes of the cylindrical radial bores 24, seen in FIG. 2, are disposed marginally beneath the center or base of the annual or grooves 22.

FIGS. 5 and 6 show perspective sectional partial views of further example embodiments of the inventive die plate 10. The die plates 10 shown in the FIGS. 5 and 6 correspond substantially to the die plate shown in the FIGS. 1 and 2, so that the same reference numbers are used for the same objects and reference is made to the explanations above. With the die plates 10 in FIGS. 5 and 6, further example embodiments of a lock against rotation are shown, which prevents a rotation of the first clamping element 28 in the radial bore 24. Naturally, such or similar locks against rotation can also be provided with the die plate from the FIGS. 1 and 2. As a lock against rotation in the example embodiment according to FIG. 5, a groove 50 running in the radial direction is provided at the bottom side of the radial bore 24. In the example shown in FIG. 5, the first clamping element 28 also has a projection 52 on its bottom side in the form of a pin corresponding to the groove 50. Because the largest outer diameter of the clamping elements 28, 30 is only marginally smaller than the inner diameter of the radial bores, the first clamping element 28 can be slid into the radial bore 24 only in one defined rotational position in which the projection 52 is aligned to the groove 50. In its slid-in state shown in FIG. 5, the first clamping element 28 is secured in this manner against rotation within the cylindrical rotation 24.

The exemplary embodiment according to FIG. 6 shows in this respect, the kinematic reverse of such a lock against rotation. In the exemplary embodiment according to FIG. 6, a groove 54 formed in the first clamping element 28 that runs in the manner of the groove 50 in the exemplary embodiment according to FIG. 5 in the radial direction and thus in the insertion direction of the first clamping element 28 into the radial bore 24. A projection 56 in the form of a pin, corresponding to the groove 54, is provided on the bottom side of the radial bore 24. As in the example according to FIG. 5, the first clamping element 28 can be inserted into the radial bore 24 only in a defined rotational position in which the projection 56 comes into engagement with the groove 54. Accordingly, in the inserted position shown in FIG. 6, the clamping element 28 cannot be rotated within the radial bore 24.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A die plate (10) for a rotor of a rotary tablet press comprising a plurality of die holes (12), with dies (16) provided therein, arranged distributed in a circumferential direction of the die plate (10), and radially running bores exist between every two adjacent die holes (12), of which a fastening device (26) is disposed in each of the radially running bores for fastening the dies (16), characterized in that at least one fastening device (26) comprises two clamping elements (28,30) disposed opposite each other in a radial bore (24) and one tensioning device (32), wherein the clamping elements (28, 30) can be tensioned against each other in a radial direction using the tensioning device (32), wherein the clamping elements (28, 30) are pressed against the dies (16) adjacent to the radial bore (24), and further characterized in that a first of the two clamping elements (28, 30) is formed sleeve-shaped having an internal thread (48), and that the tensioning device (32) has a dowel pin (32) having an external thread (38), wherein the clamping elements (28, 30) are tensioned against each other in a radial direction by screwing the dowel pin (32) into the internal thread (48) of the first clamping element (28).

2. The die plate according to claim 1, characterized in that the clamping elements (28, 30) each have two clamping surfaces (40, 42), with which they are pressed against the dies (16) adjacent to the radial bore (24).

3. The die plate according to claim 2, characterized in that the clamping surfaces (40, 42) of the clamping elements (28, 30) located opposite each other taper at least in sections in a direction of the respectively other clamping element (28, 30).

4. The die plate according to claim 3, characterized in that the clamping surfaces (40, 42) taper in a cone-shaped manner.

5. The die plate according to claim 1, characterized in that also the second clamping element (30) is formed sleeve-shaped, wherein the dowel pin (32) is guided through the second clamping element (30) and with its end extending out of the second clamping element (30) can be screwed into the first clamping element (28) and, that the dowel pin (32) has a stop (44) at which the second clamping element (30) is supported during tensioning of the clamping elements (28, 30).

6. The die plate according to claim 5, characterized in that a transfer device (46) is provided which takes the second clamping element (30) along during a removal of the dowel pin (32) from the radial bore (24).

7. The die plate according to claim 6, characterized in that the transfer device (46) comprises a locking ring (46) disposed at the dowel pin (32), wherein the second clamping element (30) is held between the stop (44) and the locking ring (46).

8. The die plate according to claim 1, characterized in that the second clamping element (30) and the dowel pin (32) are formed integrally.

9. The die plate according to claim 1, characterized in that the first clamping element (28) and the dowel pin (32) are formed integrally and the second clamping element (30) is formed sleeve-shaped, wherein the dowel pin (32) is guided through the second clamping element (30) so that the dowel pin (32) extends with one end out of the second clamping element (30) and, that the dowel pin (32) at least in the area of its end extending out of the second clamping element (30) has an external thread upon which a screw nut can be screwed for tensioning the clamping elements (28, 30) against each other.

10. The die plate according to claim 1, characterized in that the clamping elements (28, 30) during tensioning against each other engage in annular grooves (22), which are formed on outer surfaces (20) of the dies (16) adjacent to the radial bore (24).

11. The die plate according to claim 1, characterized in that at least the die holes (12) for dies (16) which are adjacent to the radial bore (24) receiving the clamping elements (28, 30) have a collar (14) as an abutment surface for the dies (16).

12. The die plate according to claim 11, characterized in that a center axis of the radial bore (24) receiving the clamping elements (28, 30) is disposed offset with respect to annular grooves (22) of the dies (16) adjacent to the radial bore (24) such that the dies (16) during tensioning the clamping elements (28, 30) against each other are pressed against respective collar (14) of their die hole (12).

13. The die plate according to claim 1, characterized in that means for locking against rotation are provided which prevent a rotation at least of the clamping elements (28, 30) in the radial bore (24).

14. The die plate according to claim 13, characterized in that the means for locking against rotation comprise a projection (52, 56) formed in the clamping element (28, 30) or in the radial bore (24), and a groove (50, 54) running in the radial bore (24) in the insertion direction of the clamping element (28, 30) formed in the respectively other clamping element (28, 30) or radial bore (24), wherein the projection (52, 56)

engages in the groove (50, 54) so that a rotation of the clamping element (28, 30) in the radial bore (24) is prevented.

15. A rotary tablet press comprising a rotor that can be driven rotatingly about an axis of rotation that has a die plate (10) according to claim 1, and comprising upper and lower punches assigned to the die holes (12) of the die plate (10) running synchronously with the die plate (10).

* * * * *